United States Patent [19]

Zenda

[11] Patent Number: 4,990,902

[45] **Date of Patent: * Feb. 5, 1991**

[54] DISPLAY AREA CONTROL SYSTEM FOR FLAT PANEL DISPLAY DEVICE

[75] Inventor: Hiroki Zenda, Tokyo, Japan

[73] Assignee: Kabushiki Kaisha Toshiba, Kawasaki, Japan

[ * ] Notice: The portion of the term of this patent subsequent to Feb. 5, 2008 has been disclaimed.

[21] Appl. No.: 207,790

[22] Filed: Jun. 17, 1988

[30] Foreign Application Priority Data

| | | | |
|---|---|---|---|
| Jun. 19, 1987 | [JP] | Japan | 62-152703 |
| Oct. 31, 1987 | [JP] | Japan | 62-276051 |
| Oct. 31, 1987 | [JP] | Japan | 62-276052 |

[51] Int. Cl.[5] ..... G09G 3/00

[52] U.S. Cl. ..... 340/731; 340/771; 382/44; 382/47

[58] Field of Search ..... 340/716, 717, 731, 750, 340/771; 382/44, 47

[56] References Cited

U.S. PATENT DOCUMENTS

| | | | |
|---|---|---|---|
| 3,928,845 | 12/1975 | Clark | 340/731 |
| 4,121,283 | 10/1978 | Walker | 340/750 |
| 4,399,524 | 8/1983 | Muguruma et al. | 365/229 |
| 4,422,163 | 12/1983 | Oldenkamp | 365/229 |
| 4,454,593 | 6/1984 | Fleming et al. | 340/750 |
| 4,536,856 | 8/1985 | Hiroishi | 340/716 |
| 4,566,005 | 1/1986 | Apperley et al. | 340/771 |
| 4,574,279 | 3/1986 | Roberts | 340/731 |
| 4,611,203 | 9/1986 | Criscimagna et al. | 340/771 |
| 4,628,534 | 12/1986 | Marshall | 382/47 |
| 4,730,186 | 3/1988 | Koga et al. | 340/708 |
| 4,751,502 | 6/1988 | Ishii et al. | 340/709 |
| 4,760,387 | 7/1988 | Ishii et al. | 340/716 |
| 4,763,279 | 8/1988 | Kellam et al. | 340/731 |
| 4,764,975 | 8/1988 | Inoue | 382/47 |
| 4,769,852 | 9/1988 | Hashimoto et al. | 382/47 |

OTHER PUBLICATIONS

"EGA Wonder", PC Magazine, vol. 6, No. 3, Feb. 10, 1987.

"IBM Enhanced Graphics Adapter", Aug. 2, 1984, pp. 1–75.

Operation Manual–Egawonder, Jan. 1987.

*Primary Examiner*—Alvin E. Oberley
*Assistant Examiner*—Richard Hjerpe
*Attorney, Agent, or Firm*—Finnegan, Henderson, Farabow, Garrett, and Dunner

[57] ABSTRACT

A display area control system having a function of switching a display mode and inhibiting alteration of the switched display mode in a flat panel display apparatus is provided. When a screen of the selected display mode is smaller than a physical screen of the flat panel display apparatus, the screen is displayed at the center of the physical screen of the plasma display apparatus. A data non-display area on the physical screen is displayed at a low luminance level in correspondence with a boundary display of a CRT display apparatus, so that a non-display area of an effective display screen can be clearly distinguished from the data non-display area.

9 Claims, 7 Drawing Sheets

FIG. 2A
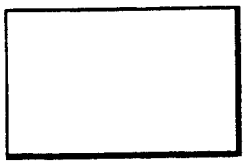
720 X 400 DOTS
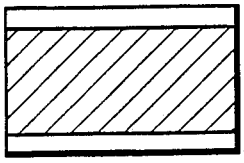
720 X 350 DOTS
FIG. 2B
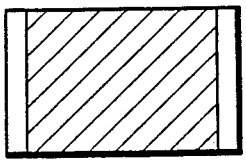
640 X 400 DOTS
FIG. 2C
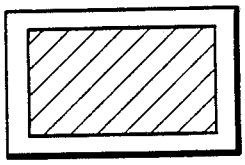
640 X 350 DOTS
FIG. 2D
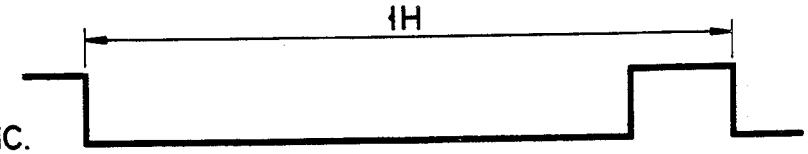
FIG. 3A
HORIZONTAL SYNC. SIGNAL
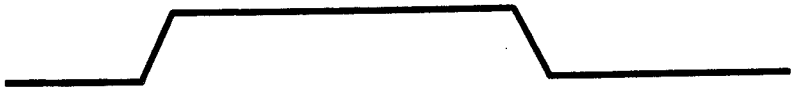
FIG. 3B
VIDEO SIGNAL
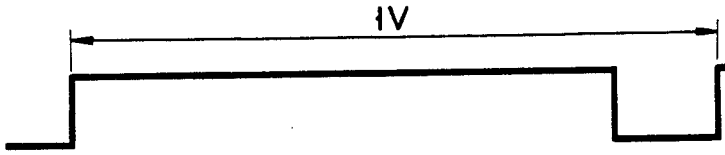
FIG. 3C
VERTICAL SYNC. SIGNAL
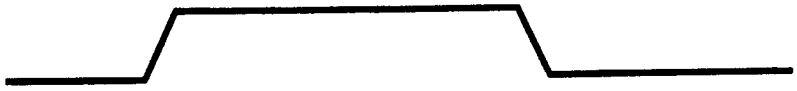
FIG. 3D
VIDEO SIGNAL
FIG. 4
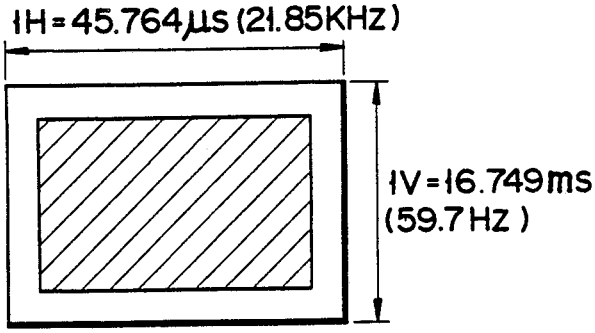

FIG. 5A VERTICAL SYNC. SIGNAL

FIG. 5B HORIZONTAL SYNC. SIGNAL

FIG. 5C VIDEO SIGNAL

FIG. 5D HORIZONTAL SYNC. SIGNAL

FIG. 5E VIDEO SIGNAL

FIG. 5F SYSTEM CLOCK SIGNAL

FIG. 7

640 X 350 DOTS

| | | DISPLAY MODE | | | | | | | | |
|---|---|---|---|---|---|---|---|---|---|---|
| | | 0/1 | 2/3 | 4/5 | 6 | 7 | D | E | F | 10 |
| R0 | HORIZONTAL TOTAL | 37 | 70 | 70 | 70 | 60 | 37 | 70 | 60 | 5B |
| R1 | HORIZONTAL DISPLAY END | 27 | 4F | 4F | 4F | 4F | 27 | 4F | 4F | 4F |
| R2 | HORIZONTAL BLANK START | 2D | 5C | 59 | 59 | 56 | 2D | 56 | 56 | 53 |
| R3 | HORIZONTAL BLANK END | 37 | 2F | 2D | 2D | 3A | 37 | 2D | 1A | 17 |
| R4 | HSYNC START | 31 | 5F | 5E | 5E | 51 | 30 | 5E | 50 | 50 |
| R5 | HSYNC END | 15 | 07 | 06 | 06 | 60 | 14 | 06 | E0 | BA |
| R6 | VERTICAL TOTAL | 04 | 04 | 04 | 04 | 70 | 04 | 04 | 70 | 6C |
| R7 | OVERFLOW | 11 | 11 | 11 | 11 | 1F | 11 | 11 | 1F | 1F |
| R10 | VSYNC START | E1 | E1 | E0 | E0 | 5E | E1 | E0 | 5E | 5E |
| R11 | VSYNC END | 24 | 24 | 23 | 23 | 2E | 24 | 23 | 2E | 2B |
| R12 | VERTICAL DISPLAY END | C7 | C7 | C7 | C7 | 5D | C7 | C7 | 5D | 5D |
| R15 | VERTICAL BLANK START | E0 | E0 | DF | DF | 5E | E0 | DF | 5E | 5F |
| R16 | VERTICAL BLANK END | F0 | F0 | EF | EF | 6E | F0 | EF | 6E | 0A |

BOUNDARY CONTROL PARAMETER (R2, R3, R4)

DISPLAY AREA CONTROL SYSTEM FOR FLAT PANEL DISPLAY DEVICE

Background of the Invention

1. Field of the Invention

The present invention relates to a display area control system for a plasma display apparatus, for changing a display area in correspondence with a plurality of different display modes having different display resolutions in a single plasma display apparatus.

2. Description of the Related Art

As a conventional display apparatus, a cathode ray tube (CRT) is normally used. Therefore, many application programs are programmed for a CRT display apparatus. In this case, an application program is programmed so that data can be displayed in a variety of display modes of different display resolutions. Examples of a display resolution are 640×400 picture elements (dots), 640×350 dots, 720×350 dots, and the like. If a display resolution is changed, a CRT controller displays data on a CRT display apparatus while changing the size of the dots.

Along with developments of lap-top type computers, a plasma display apparatus is receiving a lot of attention as a display apparatus. If a display resolution is changed, the plasma display apparatus cannot change the size of the dots. Therefore, when an application program which is developed for a CRT display apparatus is executed using the plasma display apparatus, the display area is undesirably deviated on the screen.

When the display resolution of the CRT display apparatus is lower than that of the plasma display apparatus, a boundary between a nonused area and a non-display portion in an area in use on a display screen cannot be recognized. For this reason, if a nonused area is present on the left or right, upper or lower portions of the display screen, display becomes difficult to see, thus degrading workability.

SUMMARY OF THE INVENTION

It is an object of the present invention to provide a display area control system for a plasma display apparatus, wherein when display is made in a plurality of display modes of different display resolutions in a single plasma display apparatus, a display position on a display screen can be optimized in accordance with a display resolution, and display of an effective display screen area can be clarified.

In order to achieve the above object, according to the present invention, there is provided a display area control system for a plasma display apparatus, which comprises a cathode ray tube (CRT) controller having a function of generating different display timing signals and displaying data in correspondence with different display resolutions, comprising: first memory means for storing a plurality of parameters for generating the different display timing signals in correspondence with a plurality of display resolutions; second memory means for storing the parameter for generating the display timing signal read out from the first memory means; means for designating the display resolution; setting means, responsive to the means for designating the display resolution, for reading out the parameter for generating the display timing signal from the first memory means and for setting the readout parameter in the second memory means; and inhibition means for inhibiting the setting means from setting the parameter for generating the display timing signal in the second memory means.

According to the present invention, when an application program, (note that an application program includes an operating system program hereinafter) developed for a CRT display apparatus, is executed using a plasma display apparatus, if a designated display resolution is different from a currently set display resolution, a display timing signal generating parameter corresponding to the designated display resolution is set in a display timing register in a CRT controller. Thereafter, the content of the display timing register is inhibited from being changed until the execution of the application program is completed.

After the display resolution is changed, if an effective display screen is smaller than the dot matrix of the physical screen of the plasma display apparatus, a display timing signal is generated so that the effective display screen is located at the center of the physical screen. When the effective display screen is displayed at the center of the physical screen, a display timing signal is generated such that the luminance of the remaining non-display area is set to be lower than that of a non-display state of the effective display screen, and a boundary between the effective display screen and the nondisplay area can be easily distinguished.

BRIEF DESCRIPTION OF THE DRAWINGS

Other objects and features of the present invention will be apparent from the following description taken in connection with the accompanying drawings in which:

FIGS. 2A through 2D showing arrangements of display screens of the plasma display apparatus when display resolutions are changed;

FIGS. 3 through 3D are timing charts of control signals in a CRT display apparatus;

FIG. 4 is a view showing one horizontal and vertical period in the CRT display apparatus;

FIGS. 5A through 5F are timing charts of control signals in the plasma display apparatus;

FIG. 7 is a table showing display timing signal generating parameters in the CRT display apparatus;

DETAILED DESCRIPTION OF THE PREFERRED EMBODIMENTS

An embodiment of the present invention will hereinafter be described with reference to the accompanying drawings.

Figure 1:
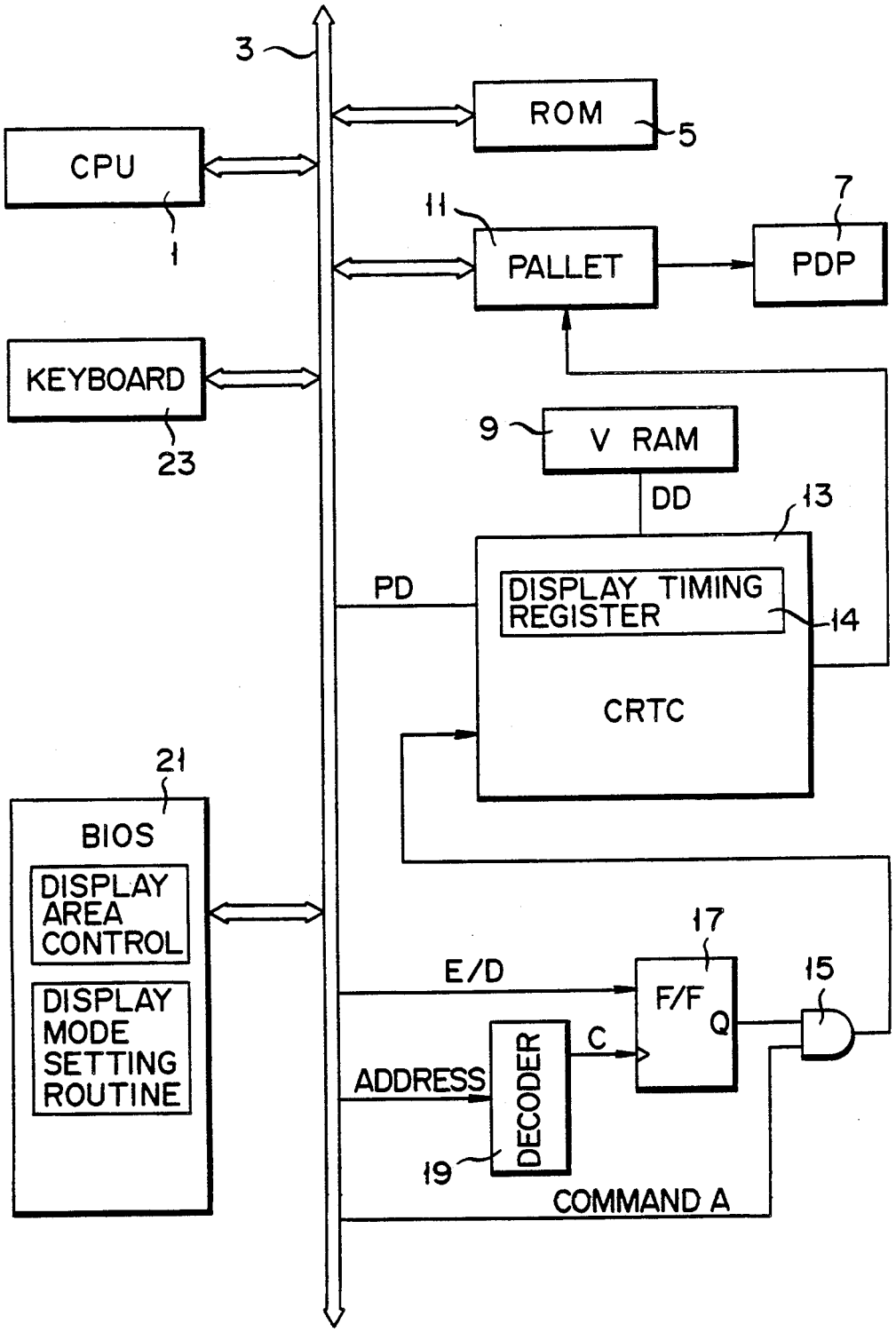
FIG. 1 is a block diagram showing an embodiment of a display area control system for a plasma display apparatus according to the present invention.

Referring to FIG. 1, central processing unit (CPU) 1 is connected to system bus 3. Read only memory (ROM) 5 stores parameters for generating display timing signals for a plasma display apparatus, and pallet data. The display timing signal generating parameters can be changed in correspondence with different display mode resolutions. More specifically, in the plasma display apparatus, when the display resolution is changed, the arrangement of a display screen is also changed as shown in FIGS. 2A through 2D. FIG. 2A shows a physical display screen of the plasma display apparatus when a dot matrix corresponds to 720×400 dots. 2B shows a display screen when the display resolution corresponds to 720×350 dots. FIG. 2C shows a display screen when the display resolution corresponds to 640×400 dots. FIG. 2D shows a display screen when the display resolution corresponds to 640×350 dots. The display timing parameters must correspondingly be changed when a display screen is changed. As shown in FIG. 3A through 3D and FIGS. 5A through 5F, the CRT display apparatus and the plasma display apparatus have different sync signal timings. In the case of the CRT display apparatus, one horizontal sync period is set to be 1H=45.764 μs(21.85 kHz), and one vertical sync period is set to be 1V=16.749 ms (59.7 Hz), as shown in FIG. 4.

Figure 6:
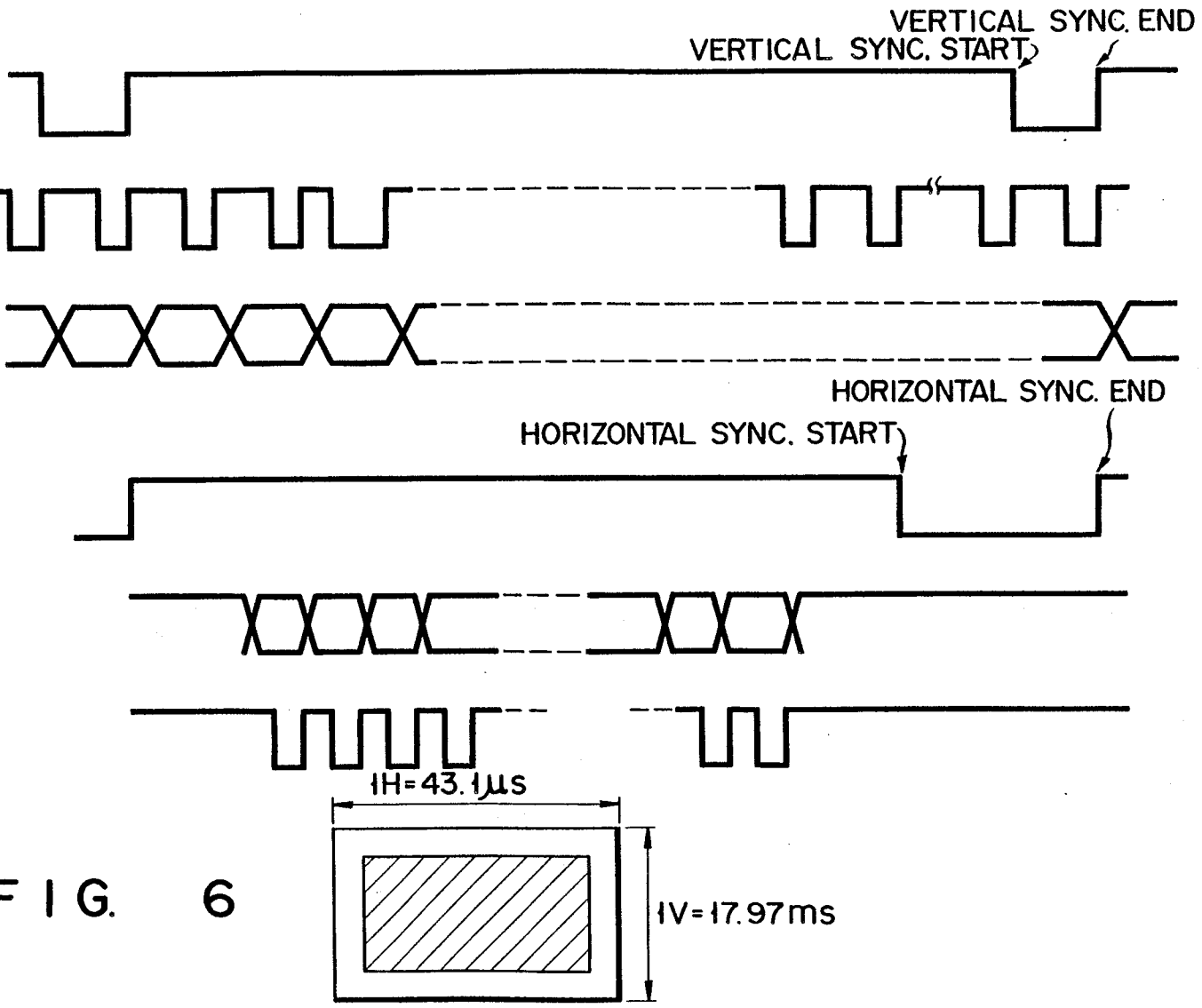
FIG. 6 is a view showing one horizontal and vertical period in the plasma display apparatus.
Figure 10:
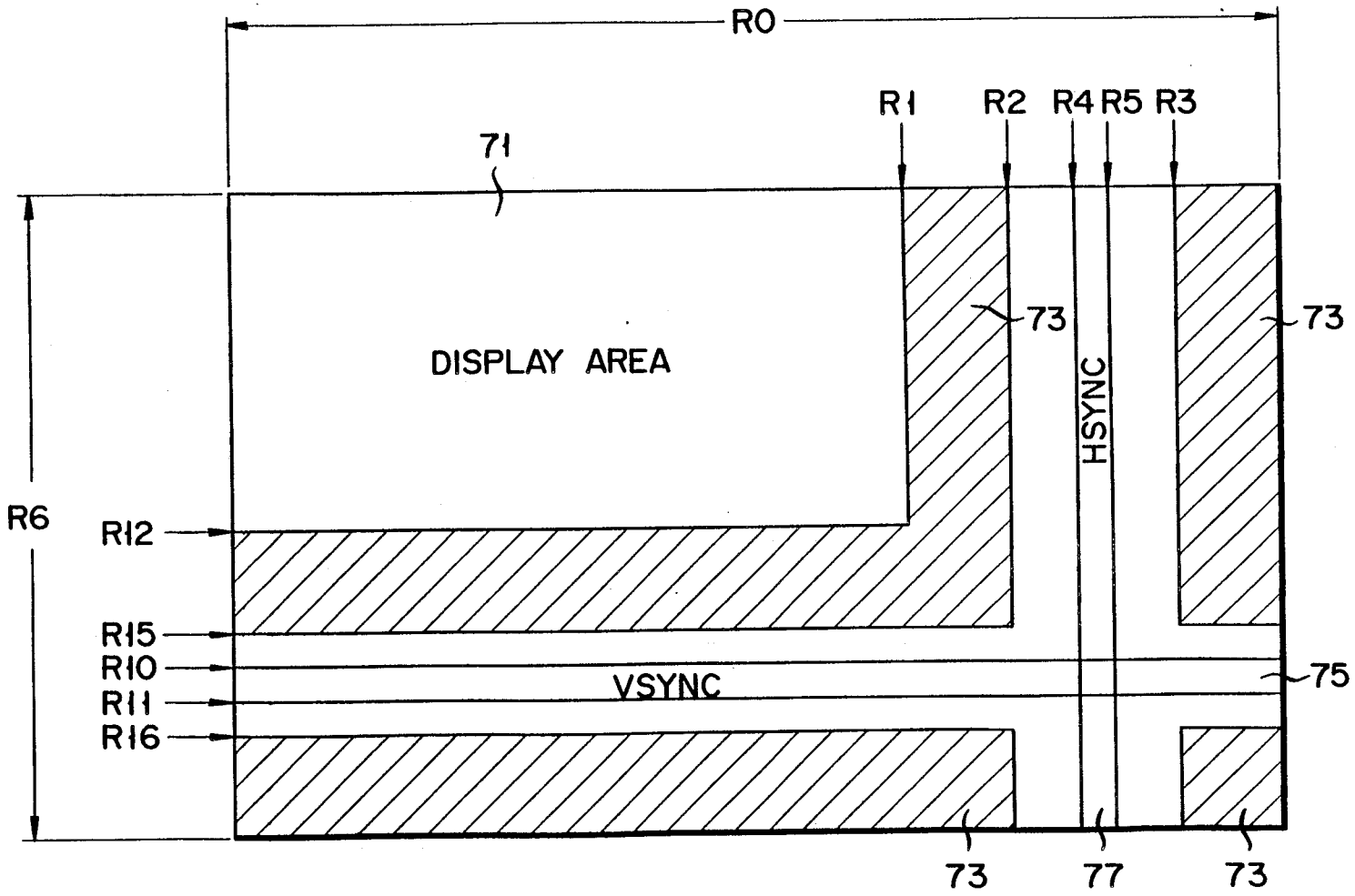
FIG. 10 is a view for explaining parameters R0 through R16 shown in FIG. 7.

On the other hand, in the case of the plasma display apparatus, one horizontal sync period is set to be 1H=43.1 μs, and one vertical sync period is set to be 1V=17.19 ms, as shown in FIG. 6. FIG. 7 shows an example of display timing signal generating parameters for the CRT. The correspondence between parameters R0 via R16, shown in FIG. 7, and the display screen is shown in FIG. 10. In FIG. 10, reference numeral 71 denotes a display area; 73, border areas; and 77 and 75, horizontal and vertical sync periods, respectively. As shown in FIG. 10, parameter R0 represents a total horizontal period of the display screen. Parameter R1 represents the end timing of a horizontal display period. Parameters R2 and R3 represent the start and end timings of a horizontal blank period, respectively. Parameters R2 and R3 constitute a boundary control parameter. Parameters R4 and R5 represent start and end timings of a horizontal sync signal, respectively. Parameter R6 represents a total vertical period of the display screen. Parameter R7 represents the overflowing portion of the parameter when the parameter is too lengthy to be stored in a single register. Parameters R10 and R11 represent the start and end timings of a vertical sync signal, respectively. Parameter R12 represents the end timing of a vertical display. Finally, parameters R15 and R16 represent the start and end timings of a vertical blank period, respectively. For example when the display resolution corresponds to 640×350 dots, a horizontal total parameter is set to be "5B"; a horizontal display end parameter, "4F"; a horizontal blank start parameter, "53"; a horizontal blank end parameter, "17"; an H sync start parameter, "50"; an H sync end parameter, "BA"; a vertical total parameter, "6C"; an overflow parameter, "1F"; a V sync start parameter, "5E"; a V sync end parameter, "2B"; a vertical display end parameter, "5D"; a vertical blank start parameter, "5F"; and a vertical blank end parameter, "0A". When the panel resolution of the plasma display apparatus is selected to be 720×400 dots, data non-display areas, each consisting of the same number of dots, are formed on the left and right and/or the upper and lower portions of the physical screen, so that the display screen is located at the center of the physical screen. The parameter stored in ROM 5 is also used for generating a display timing signal for forming the non-display area. Pallet data is used for converting display data for CRT color display read out from V-RAM 9 into tone display data for the plasma display. In this embodiment, 16 colors are expressed by four tonal levels. For example, tonal level "0" is a nondisplay level having no luminance; "1", a tone having a low luminance level; and "3", a tone having a high luminance level. In this embodiment, pallet data A for displaying the data non-display area at tonal level "0" and pallet data B for displaying the non-display area at tonal level "1" are stored in ROM 5, and one of these pallet data is selected and set in pallet 11 (to be described later).

CRT controller (CRTC) 13 is connected to CPU 1 through system bus 3. CRTC 13 has display timing register 14. CRTC 13 receives a display timing signal parameter (PD) on system bus 3 in synchronism with display timing set command A (A="1") supplied from CPU 1 through AND gate 15, and sets it in display timing register 14. CRTC 13 generates a display timing signal based on the received parameter, and outputs the signal to pallet 11. CRTC 13 fetches display data DD from V-RAM 9, and supplies this data to pallet 11. Pallet 11 receives either pallet data A or B stored in ROM 5 through system bus 3 and converts display data for CRT color display read out from V-RAM 9 into four tonal levels of display data, and supplies it to plasma display 7.

When control data E/D supplied from CPU 1 is "1", flip-flop 17 is set, and its Q output goes to "1". When data E/D is "0", flip-flop 17 is reset, and its Q output goes to "0". The timing at which an E/D signal is set in flip-flop 17 is determined in synchronism with clock signal C output from decoder 19. Decoder 19 decodes an I/O device address supplied from CPU 1. When the decoded address represents an I/O device address of CRTC 13, decoder 19 supplies clock signal C to a clock input terminal of flip-flop 17. When data E/D is "1", i.e., when flip-flop 17 is set, AND gate 15 supplies a display timing set command to CRTC 13. When data E/D is "0", i.e., when flip-flop 17 is reset, AND gate 15 does not supply the command to CRTC 13. Basic input-/output program (BIOS) 21 is connected to system bus 3, and stores a display area control program shown in FIG. 8 and a display mode set routine (not shown).

Keyboard 23 of inputting various data including a BIOS command is connected to system bus 3.

Figure 8:
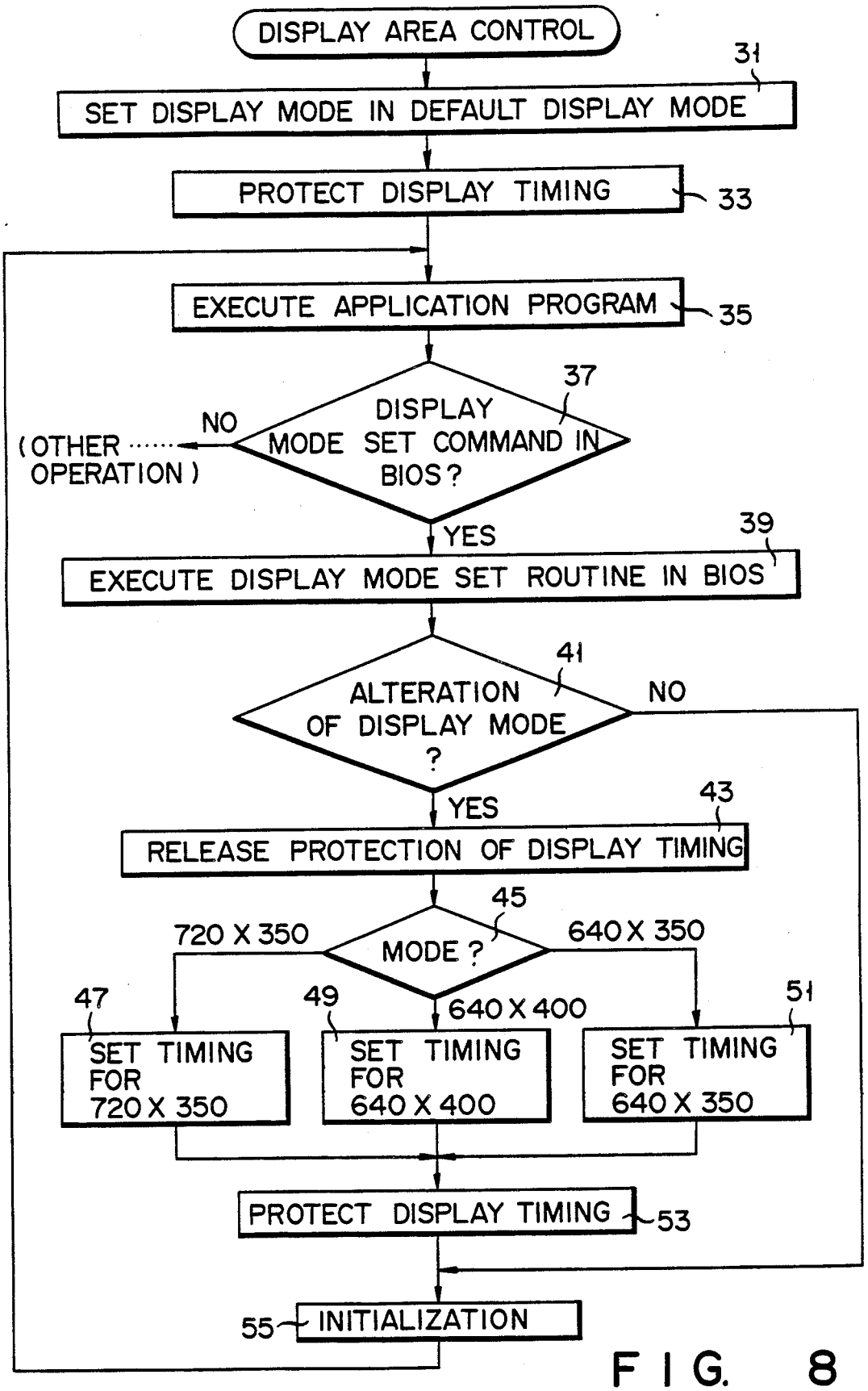
FIG. 8 is a flow chart showing processing for setting a display mode in the embodiment shown in FIG. 1.

The operation of the embodiment of the present invention with the above arrangement will be described with reference to the flow chart shown in FIG. 8.

When the power switch of the system is turned on, CPU 1 executes the display area control processing routine in BIOS 21. In step 31 of FIG. 8, CPU 1 sets a default mode (having a display resolution of 640×400 dots shown in FIG. 2C) as a display mode for plasma display 7. More specifically, CPU 1 reads out the display timing signal generating parameters (PD) in the default display mode from ROM 5, and sets the readout parameters in display timing register 14 of CRTC 13 through system bus 3. CPU 1 reads out the currently set pallet data from ROM 5, and sets the readout data in pallet 11 through system bus 3.

In step 33, CPU 1 protects the display timing. More specifically, CPU 1 supplies control signal E/D of logic "0" to flip-flop 17 through system bus 3. CPU 1 supplies the I/O device address of CRTC 13 to decoder 19 through system bus 3. Decoder 19 decodes the input I/O device address, and supplies clock signal C to the clock input terminal of flip-flop 17. As a result, flip-flop 17 is reset, and outputs a signal of logic "0" from its Q output terminal to one input terminal of AND gate 15. Therefore, even if a new display timing set command is input from CPU 1 to the other input terminal of AND gate 15 through system bus 3, AND gate 15 blocks supply of command A to CRTC 13.

In step 35, an application program is executed.

The flow then advances to step 37. When a display mode set command is input at keyboard 23 during execution of the application program, CPU 1 supplies display mode set command A to one input terminal of AND gate 15 through system bus 3, and executes the display mode set routine in BIOS 21. If it is determined in step 41 that the display mode is not altered, the flow advances to step 55, and CPU 1 executes initialization including clearing of V-RAM 9.

However, if it is determined in step 41 that the display mode is altered, the flow advances to step 43, and CPU 1 controls flip-flop 17 and decoder 19, so that new display timing parameters can be set in display timing register 14. More specifically, CPU 1 supplies control data E/D of logic "1" to flip-flop 17 through system bus 3, and sets the I/O device address of CRTC 13 in decoder 19. As a result, decoder 19 decodes the input I/O device address, and supplies high-level clock signal C to the clock input terminal of flip-flop 17. As a result, flip-flop 17 is set in synchronism with clock signal C. Therefore, a high-level Q output signal is supplied from flip-flop 17 to the other input terminal of AND gate 15. The AND condition is then established, and AND gate 15 supplies a signal of high level (logic "1") to CRTC 13. Thus, protection of the display timing parameters is released. In step 45, CPU 1 discriminates the display mode. If the display mode is the default mode, i.e., if the display resolution is 720×350 dots, the flow advances to step 47. In step 47, CPU 1 reads out display timing signal generating parameters PD for 720×350 dots from ROM 5, and sets them in display timing register 14 of CRTC 13 through system bus 3. If it is determined in step 45 that the display mode corresponds to 640×400 dots, the flow advances to step 49. In step 49, display timing signal generating parameters PD for 640×400 dots are read out from ROM 5, and are set in display timing register 14 through system bus 3. Similarly, when the display mode corresponds to 640×350 dots, display timing signal generating parameters PD for 640×350 dots are read out from ROM 5, and are set in display timing register 14 through system bus 3.

The same processing as in step 33 is executed in step 53 to protect the display timing. In step 55, initialization including clearing of V-RAM 9 is executed. The flow then returns to step 35, and CPU 1 executes the next application program. In this manner, in one application program, the display timing signal generating parameters can be altered only once, and thereafter, are inhibited from being altered until the application program ends.

A second embodiment of the present invention will be described hereinafter.

In this embodiment, when data is displayed on a plasma display apparatus using an application program developed for a CRT display apparatus, if a display mode is altered, the display screen can be set at the center of the plasma display apparatus. The operation of this embodiment will be described below. Assume that the physical screen of the plasma display apparatus has a resolution of 720×400 dots, as shown in FIG. 2A. Meanwhile, if the display mode altered in step 45 of FIG. 8 corresponds to 720×350 dots, a difference in the number of dots in the vertical direction (400−350) is calculated to obtain a difference (=50 dots). Display timing signal generating parameters (PD) having display timings for forming upper and lower nondisplay areas of 25 dots, as shown in FIG. 2B, are read out from ROM 5, and are set in display timing register 14 of CRTC 13 through system bus 3. As a result, CRTC 13 generates display timing signals based on input parameters PD, and supplies the signals to plasma display apparatus 7 through pallet 11. Then, a screen having an effective display area indicated by a hatched portion and having the same upper and lower data nondisplay areas, as shown in FIG. 2B, is formed on plasma display apparatus 7.

In step 41, when the display mode corresponds to 640×400 dots, a dot difference (720−640) in the horizontal direction is calculated to obtain a difference (=80 dots). Then, display timing signal generating parameters (PD) having display timings for forming right and left nondisplay areas of 40 dots, as shown in FIG. 2C, are read out from ROM 5, and are set in display timing register 14 of CRTC 13 through system bus 3. As a result, CRTC 13 generates display timing signals based on input parameters PD, and supplies the signals to plasma display apparatus 7 through pallet 11. Thus, a screen having an effective display area indicated by a hatched portion and having the same right and left data nondisplay areas, as shown in FIG. 2C, is formed on plasma display apparatus 7.

If it is determined in step 41 that the display mode corresponds to 640×350 dots, a dot difference (720−640) in the horizontal direction is calculated to obtain a difference (=80 dots), and a dot difference (400−350) in the vertical direction is calculated to obtain a difference (=50 dots). Then, as shown in FIG. 2D, display timing signal generating parameters (PD) having display timings for forming upper and lower nondisplay areas consisting of 25 dots, and right and left nondisplay areas consisting of 40 dots, are read out from ROM 5, and are set in display timing register 14 of CRTC 13 through system bus 3. As a result, CRTC 13 generates display timing signals based on input parameters PD, and supplies them to plasma display apparatus 7 through pallet 11. Then, a screen having an effective display screen indicated by a hatched portion and having the same upper and lower, and right and left data non-display areas is formed on plasma display apparatus 7.

A third embodiment of the present invention will be described with reference to the flow chart shown in FIG. 9.

Figure 9:
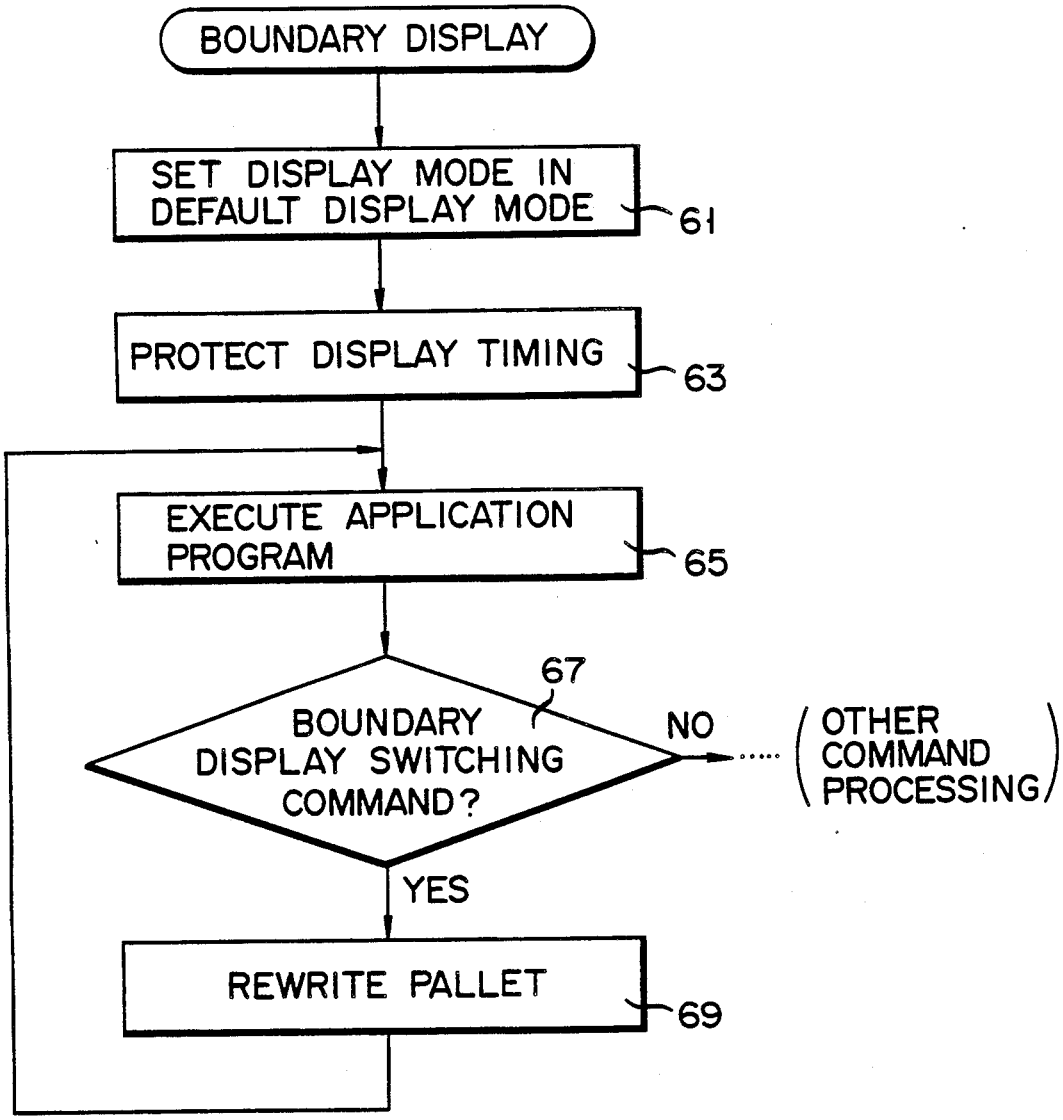
FIG. 9 is a flow chart showing processing for switching a tone level of boundary display of a screen in the plasma display apparatus.

In step 61 of FIG. 9, CPU 1 sets plasma display apparatus 7 in the default display mode. In step 63, CPU 1 inhibits alteration of the display mode. The flow then advances to step 65, and CPU 1 executes an application program. It is checked in step 67 if a boundary display switching command (a command from keyboard 23 or a command on a program) is input during execution of the application program. If YES in step 67, CPU 1 rewrites pallet data set in pallet 11 in step 69. More specifically, when pallet data A for displaying the data nondisplay area at a nondisplay level having no luminance (tone level "0") is set, it is rewritten to be pallet data B for displaying the data nondisplay area in tone of low luminance level (tone level "1"). On the contrary, if pallet data B is set, it is rewritten to be pallet data A.

As a result, if pallet data 8 is set in pallet 11, data output from CRTC 13 for the nondisplay area is converted to display area having tone of low luminance level (tone level "1") by pallet 11, and the data is sent to plasma display apparatus 7. As a result, the nondisplay area is displayed on the plasma display apparatus in the same manner as boundary display in the CRT display apparatus. Since the luminance of the nondisplay area can be set to be lower than that of a no-display state, a boundary between the effective display area and the nondisplay area can be clarified.

What is claimed is:

1. A display area control system for displaying on a flat panel display apparatus applied data generated by a desired application program, the display apparatus having the capability to display data corresponding to a plurality of different display resolutions, the control system comprising:

control means for generating different display timing signals, corresponding to one of the plurality of different display resolutions, in accordance with a designated set of display timing signal generating parameters, and for supplying applied data generated by the application program for display on the flat panel display apparatus;

means for coupling the control means to the flat panel display apparatus;

first memory means for storing a plurality of sets of display timing signal generating parameters corresponding to the plurality of different display resolutions;

display resolution selecting means for selecting a desired display resolution;

second memory means for storing a set of received display timing signal generating parameters as the designated set of display timing signal generating parameters;

setting means responsive to the display resolution selecting means for reading out a desired set of display timing signal generating parameters, corresponding to the desired display resolution, from the first memory means and for supplying the desired set of display timing signal generating parameters to the second memory means as the designated set of display timing signal generating parameters; and inhibition means, coupled to the control means, for permitting the setting means to alter the designated set of display timing signal generating parameters stored in the second memory means, when both (1) the desired set of display timing signal generating parameters is different from the set of display timing signal generating parameters stored in the second memory means and (2) the designated set of display timing signal generating parameters has not been altered since the desired application program has been executed, and for inhibiting alteration of the designated set of display timing signal generating parameters under other conditions.

2. A control system according to claim 1, wherein said inhibition means permits the designated set of display timing signal generating parameters to be altered once during execution of the desired application program.

3. A control system according to claim 2, wherein the desired application program is a program which has been programmed to display data on a CRT display apparatus.

4. A display area control system for displaying on a flat panel display apparatus applied date generated by a desired application program, the display apparatus including a physical screen having a picture element matrix with maximum numbers of picture elements in the vertical and horizontal directions and including the capability to display data corresponding to a plurality of different display resolutions each produced in response to respective ones of a plurality of sets of display timing signals, each of the different display resolutions providing an effective display area with predetermined numbers of picture elements in the vertical and horizontal directions and at least one non-display area, the control system comprising:

control means for generating selected ones of a plurality of sets of display timing signals, each display timing signal set corresponding to one of the plurality of different display resolutions, in accordance with a designated set of display timing signal generating parameters, and for supplying applied data generated by the application program for display on the flat panel display apparatus;

means for coupling the control means to the flat panel display apparatus;

first memory means for storing a plurality of sets of display timing signal generating parameters corresponding to the plurality of different display resolutions;

display resolution selecting means for selecting a desired display resolution;

second memory means for storing a set of received display timing signal generating parameters as the designated set of display timing signal generating parameters;

setting means responsive to the display resolution selecting means for reading out a desired set of display timing signal generating parameters, corresponding to the desired display resolution, from the first memory means and for supplying the desired set of display timing signal generating parameters to the second memory means as the designated set of display timing signal generating parameters; and centering means, coupled to the control means and responsive to selected ones of the plurality of sets of display timing signals generated by said control means, for locating the effective display area substantially in the center of the physical screen.

5. A control system according to claim 4, wherein, when said display resolution selecting means selects a display resolution which differs from the display resolution corresponding to the designated set of display timing signal generating parameters, and when the predetermined number of picture elements in a vertical direction of the selected display resolution is smaller than the maximum number of picture elements in the vertical direction, said control means generates display timing signals so that non-display areas having picture elements which number ½ a difference between the predetermined and maximum numbers of picture elements in the vertical direction are formed on the upper and lower portions of the physical screen of the flat panel display apparatus.

6. A control system according to claim 4, wherein, when said display resolution selecting means selects a display resolution which differs from the display resolution corresponding to the designated set of display timing signal generating parameters, and when the predetermined number of picture elements in the horizontal direction of the selected display resolution is smaller than the maximum number of picture elements in the horizontal direction, said control means generates display timing signals so that non-display areas having picture elements which number ½ a difference between the predetermined and maximum numbers of picture elements in the horizontal direction are formed on the right and left portions of the physical screen of the flat panel display apparatus.

7. A control system according to claim 4, wherein, when said display resolution selecting means selects a display resolution which differs from the display resolution corresponding to the designated set of display timing signal generating parameters, and when the predetermined numbers of picture elements in the vertical and horizontal directions of the selected display resolution are smaller than the maximum numbers of picture elements in the vertical and horizontal directions, said control means generates display timing signals so that non-display areas having picture elements which number ½ a difference between the predetermined and maximum numbers of picture elements in the vertical and horizontal directions are respectively formed on the upper, lower, right, and left portions of the physical screen of the flat panel display apparatus.

8. A display area control system for displaying on a flat panel display apparatus applied data generated by a desired application program, the display apparatus including a physical screen having a picture element matrix with a maximum number of picture elements in the vertical and horizontal directions and including the capability to display data corresponding to a plurality of different display resolutions each produced in response to respective ones of a plurality of sets of display timing signals, each of the different display resolutions providing an effective display area with a predetermined number of picture elements in the vertical and horizontal directions each having a variable luminance level to distinguish between a data display state and a no-display state and providing at least one non-display area, the control system comprising:

control means for generating selected ones of a plurality of sets of display timing signals, each display timing signal set corresponding to one of the plurality of different display resolutions, in accordance with a designated set of display timing signal generating parameters, and for supplying applied data generated by the application program for display on the flat panel display apparatus;

means for coupling the control means to the flat panel display apparatus;

first memory means for storing a plurality of sets of display timing signal generating parameters corresponding to the plurality of different display resolutions;

display resolution selecting means for selecting a desired display resolution;

second memory means for storing a set of received display timing signal generating parameters as the designated set of display timing signal generating parameters;

setting means responsive to the display resolution selecting means for reading out a desired set of display timing signal generating parameters, corresponding to the desired display resolution, from the first memory means and for supplying the desired set of display timing signal generating parameters to the second memory means as the designated set of display timing signal generating parameters;

centering means, coupled to the control means and responsive to selected ones of the plurality of sets of display timing signals generated by said control means, for locating the effective display area substantially in the center of the physical screen; and boundary display control means for controlling the control means to display the picture elements of the non-display area at a luminance level which is different than the luminance level of the no-display state when the effective display area is located at the center of the physical screen.

9. A control system according to claim 8, wherein said boundary display control means comprises a pallet, and wherein said first memory means stores pallet data of different luminance levels to be set in said pallet, and wherein said boundary display control means sets pallet data of different luminance levels in said pallet to distinguish between the effective display area and the non-display area.

* * * * *